US006830797B2

(12) United States Patent
Haataja

(10) Patent No.: US 6,830,797 B2
(45) Date of Patent: Dec. 14, 2004

(54) WOOD STRAND MOLDED PART HAVING HOLES WITH DENSIFIED AND THINNER PERIMETERS AND METHOD OF MAKING SAME

(75) Inventor: Bruce A. Haataja, Lake Linden, MI (US)

(73) Assignee: GFP Strandwood Corporation, Hancock, MI (US)

( * ) Notice: Subject to any disclaimer, the term of this patent is extended or adjusted under 35 U.S.C. 154(b) by 0 days.

(21) Appl. No.: 10/468,698

(22) PCT Filed: Feb. 21, 2001

(86) PCT No.: PCT/US01/05486

§ 371 (c)(1),
(2), (4) Date: Aug. 21, 2003

(87) PCT Pub. No.: WO02/068165

PCT Pub. Date: Sep. 6, 2002

(65) Prior Publication Data

US 2004/0056379 A1 Mar. 25, 2004

(51) Int. Cl.[7] ..... B27N 5/00

(52) U.S. Cl. ..... 428/106; 264/119; 264/155; 264/156; 108/53.3

(58) Field of Search ..... 264/109, 119, 264/155, 156; 428/106, 292.4; 108/53.3

(56) References Cited

U.S. PATENT DOCUMENTS

| | | | | |
|---|---|---|---|---|
| 3,164,511 | A | 1/1965 | Elmendorf | 428/110 |
| 3,238,281 | A | 3/1966 | Kato | 264/109 |
| 3,354,248 | A | 11/1967 | Haas et al. | 264/119 |
| 4,131,705 | A | 12/1978 | Kubinsky | 428/106 |
| 4,213,928 | A | 7/1980 | Casselbrant | 264/113 |
| 4,241,133 | A | 12/1980 | Lund et al. | 428/326 |
| 4,246,310 | A | 1/1981 | Hunt et al. | 428/106 |
| 4,248,163 | A | 2/1981 | Caughey et al. | 108/53.3 |
| 4,248,820 | A | 2/1981 | Haataja | 264/113 |
| 4,337,710 | A | 7/1982 | Haataja et al. | 108/53.3 |
| 4,384,019 | A | 5/1983 | Haataja | 428/106 |
| 4,408,544 | A | 10/1983 | Haataja | 108/53.3 |
| 4,440,708 | A | 4/1984 | Haataja et al. | 264/109 |
| 4,469,216 | A | 9/1984 | Haataja et al. | 198/382 |
| 4,790,966 | A | 12/1988 | Sandberg et al. | 264/39 |
| 4,960,553 | A | 10/1990 | DeBruine et al. | 264/113 |

*Primary Examiner*—Mary Lynn Theisen
(74) *Attorney, Agent, or Firm*—Price, Heneveld, Cooper, DeWitt & Litton, LLP

(57) ABSTRACT

A molded wood flake or strand part (14) is shown, having a densified and/or thinner perimeter surrounding a hole (15) in the part. The method of making such part includes narrowing the mold cavity surrounding the hole, and/or providing a hole punch (17) with a shoulder which projects beyond the surface of the mold, to further compress the wood flakes or strands near the hole.

19 Claims, 2 Drawing Sheets

WOOD STRAND MOLDED PART HAVING HOLES WITH DENSIFIED AND THINNER PERIMETERS AND METHOD OF MAKING SAME

BACKGROUND OF THE INVENTION

A. Field of the Invention

The present invention relates to wood flake molding.

B. Background of the Art

Wood flake molding, also referred to as wood strand molding, is a technique invented by wood scientists at Michigan Technological University during the latter part of the 1970s for molding three-dimensionally configured objects out of binder coated wood flakes having an average length of about 1¼ to about 6 inches, preferably about 2 to about 3 inches; an average thickness of about 0.005 to about 0.075 inches, preferably about 0.015 to about 0.030 inches; and an average width of 3 inches or less, most typically 0.25 to 1.0 inches, and never greater than the average length of the flakes. These flakes are sometimes referred to in the art as "wood strands." This technology is not to be confused with oriented strand board technology (see e.g., U.S. Pat. No. 3,164,511 to Elmendorf) wherein binder coated flakes or strands of wood are pressed into planar objects. In wood flake or wood strand molding, the flakes are molded into three-dimensional, i.e., non-planar, configurations.

In wood flake molding, flakes of wood having the dimensions outlined above are coated with MDI or similar binder and deposited onto a metal tray having one open side, in a loosely felted mat, to a thickness eight or nine times the desired thickness of the final part. The loosely felted mat is then covered with another metal tray, and the covered metal tray is used to carry the mat to a mold. (The terms "mold" and "die", as well as "mold die", are sometimes used interchangeably herein, reflecting the fact that "dies" are usually associated with stamping, and "molds" are associated with plastic molding, and molding of wood strands does not fit into either category.) The top metal tray is removed, and the bottom-metal tray is then slid out from underneath the mat, to leave the loosely felted mat in position on the bottom half of the mold. The top half of the mold is then used to press the mat into the bottom half of the mold at a pressure of approximately 600 psi, and at an elevated temperature, to "set" (polymerize) the MDI binder, and to compress and adhere the compressed wood flakes into a final three-dimensional molded part. The excess perimeter of the loosely felted mat, that is, the portion extending beyond the mold cavity perimeter, is pinched off where the part defining the perimeter of the upper mold engages the part defining perimeter of the lower mold cavity. This is sometimes referred to as the pinch trim edge.

U.S. Pat. Nos. 4,440,708 and 4,469,216 disclose this technology. The drawings in U.S. Pat. No. 4,469,216 best illustrate the manner in which the wood flakes are deposited to form a loosely felted mat, though the metal trays are not shown. By loosely felted, it is meant that the wood flakes are simply lying one on top of the other in overlapping and weaving fashion, without being bound together in any way. The binder coating is quite dry to the touch, such that there is no stickiness or adherence which holds them together in the loosely felted mat. The drawings of U.S. Pat. No. 4,440,708 best illustrate the manner in which a loosely felted mat is compressed by the mold halves into a three-dimensionally configured article (see FIGS. 2-7, for example).

This is a different molding process as compared to a molding process one typically thinks of, in which some type of molten, semi-molten or other liquid material flows into and around mold parts. Wood flakes are not molten, are not contained in any type of molten or liquid carrier, and do not "flow" in any ordinary sense of the word. Hence, those of ordinary skill in the art do not equate wood flake or wood strand molding with conventional molding techniques.

One limitation heretofore associated with this technology has been forming holes in molded wood strand parts. The part tends to be too weak at the perimeter of the hole.

SUMMARY OF THE INVENTION

In the present invention it has been discovered that narrowing the space between the top and bottom molds in the area immediately surrounding and defining a molded hole can strengthen the hole perimeters. By compressing a relatively uniformly thick mat into a narrower space in the perimeter of the hole, a denser, thinner, and stronger perimeter around the hole is created. Furthermore, where the hole is in a raised boss, the entire boss can be strengthened and densified in a similar manner.

These and other features, advantages and objects of the present invention will be further understood and appreciated by those skilled in the art by reference to the following specification and claims.

DETAILED DESCRIPTION OF THE PREFERRED EMBODIMENTS

Figure 1:
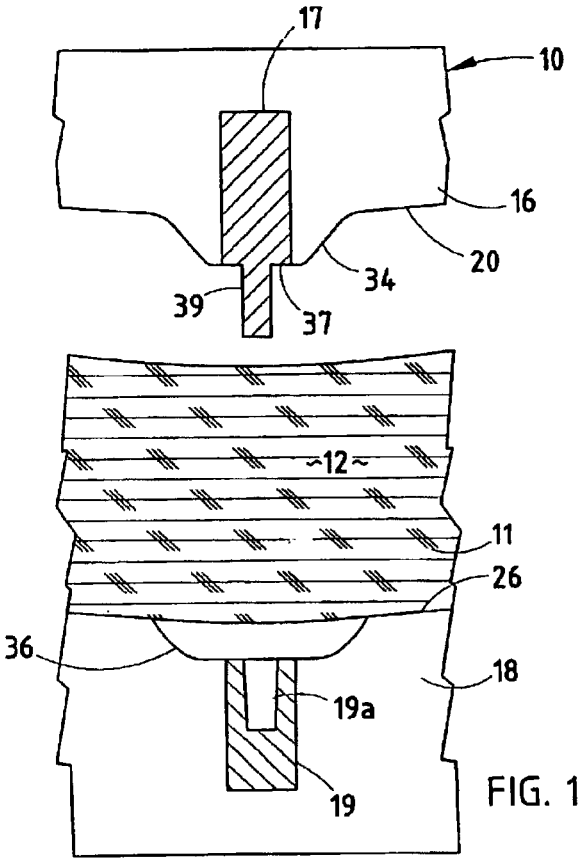
FIG. 1 is a side elevational cross-sectional view of the spaced upper and lower mold halves with a loosely felted mat of wood flakes positioned therebetween.

For purposes of description herein, the terms "upper," "lower," "right," "left," "rear," "front," "vertical," "horizontal," and derivatives thereof shall relate to the invention as orientated in the drawings. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
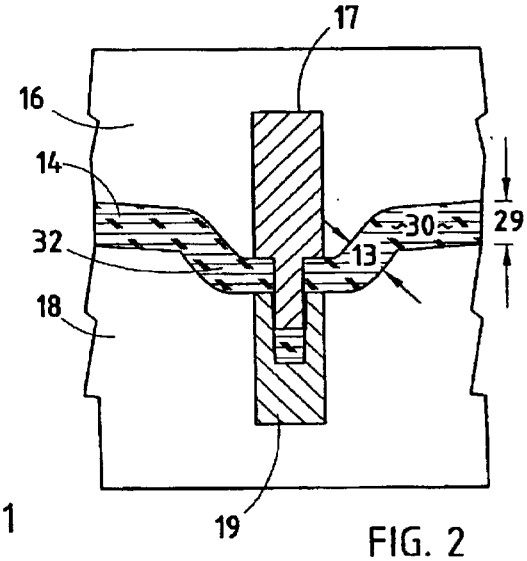
FIG. 2 is the same view of FIG. 1 with the mold closed, whereby the wood flakes are consolidated, compressed, and cured under heat and pressure to form a molded wood flake part, having a hole in a boss.

The mold 10 is used to form loosely felted mat 11 of wood flakes 12 into a molded wood flake part 14 (FIG. 2). The mold 10 includes a top mold die 16 and a bottom mold die 18. The top mold die 16 includes a surface 20 and a male hole forming punch 17 defining a hole forming projection 39, which projects beyond a shoulder 37. Shoulder 37 is flush with the surface 20 of the top mold die 16. The bottom mold die 18 includes a surface 26 and a punch receiver 19 having a cavity 19*a* therein for receiving projection. Cavity 19*a* is slightly larger than projection 39, to accommodate excess wood flake scrap forced therein.

The surface 20 of the top mold die 16 and the surface 26 of the bottom mold die 18 define a cavity 30 therebetween when the mold is in a closed position. The defined cavity 30 is wider 29 away from, and narrower 13 near, the male hole forming punch 17 and punch receiver 19 (FIG. 1). In the embodiment shown, top mold die 16 includes a boss forming projection 34 surrounding the male hole punch 17, and the lower mold die includes a boss forming recess, or well 36, surrounding the punch receiver 19.

In the illustrated example, the molded wood flake part 14 is made by positioning a loosely felted mat 11 of wood flakes 12 on the bottom mold die 18 (FIG. 1). The surface 20 of the top mold die 16 is designed to fit closer to the surface 26 of the bottom mold die 18 around the boss 32 and hole 15 (FIG. 2) when the top mold die 16 and bottom mold die 18 are brought together. The male hole forming punch 17 is designed to fit with the punch receiver 19.

As noted in the Background, such mats are typically layered to eight or nine times the desired thickness of the final part.

Mat 11 is of relatively uniform thickness, though it can be made thicker or thinner in portions by adding or removing wood flakes 12.

Figure 3:
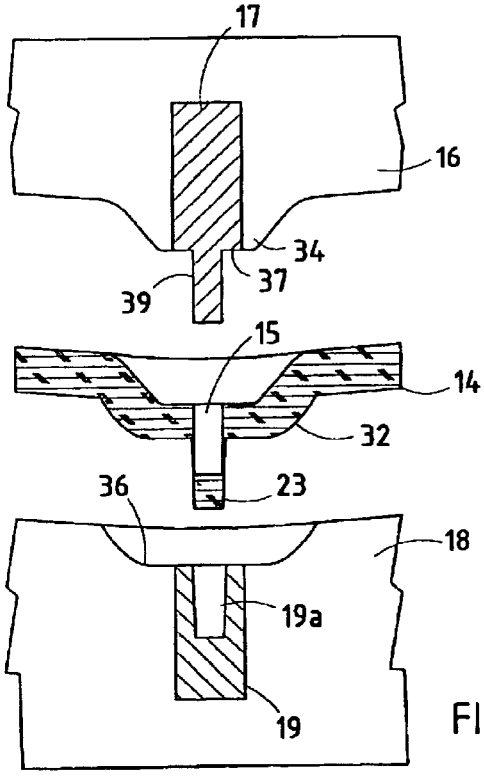
FIG. 3 is a side elevational view of the mold apparatus of FIG. 1 with the mold reopened and the part removed.

The top mold die 16 and the bottom mold die 18 are then compressed (FIG. 2) and heat and pressure are applied to the felted mat 11. The felted mat 11 is thereby compressed and cured into the molded wood flake part 14 having a hole 15 (FIG. 3). The narrower width 13 between the surface 20 of the top mold die 16 and the surface 26 of the bottom mold die 18 further compacts the loosely felted mat 11 of wood flakes 12 in the area around the boss 32 and hole 15 when the top mold die 16 and the bottom mold die 18 are compressed.

The strength of molded wood flake parts 14 is highly dependent on material density. The target density for the molded wood flake parts 14 is approximately 42 pounds per cubic foot (pcf). Additional densification will improve strength, but as density increases, there is risk of excessive spring back and blistering, requiring lower moisture levels and longer press times. It is usually impractical to densify large areas beyond 50 pcf, however, smaller areas such as those around molded bosses and/or holes, may have higher limits such as 60 pcf since the nearby lower density zone can be degassed.

As an example, part 14 has a target density of 42 pcf. If the molded wood flake part 14 were made with a raised boss 32 having a hole 15 with the same thickness as the rest of the part 14, then the density in the raised boss 32 would be approximately 36.8 pcf. By reducing the thickness of the part 14 in the area of the boss 32 and the hole 15 by 1/16th of an inch, the density of the thinner portion 21 would be approximately 40.3 pcf.

Figure 4:
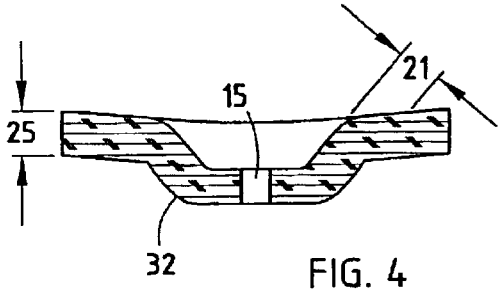
FIG. 4 is a side elevational view of the part once removed from the mold.

The wood flake part 14 has a thicker portion 25 away from the hole 15, and a thinner portion 21 near the hole 15 and boss 32 (FIG. 4). The density of the thinner portion 21 may be near to or more than the target density of the entire part 14. When the top mold die 16 and the bottom mold die 18 are separated, the wood flake part 14 may have a cap 23 that is formed as a result of the compression of the mat 11 of wood flakes 12 at or near the hole 15 (FIG. 3). This cap 23 can be removed from the wood flake part 14 (FIG. 4).

Figure 5:
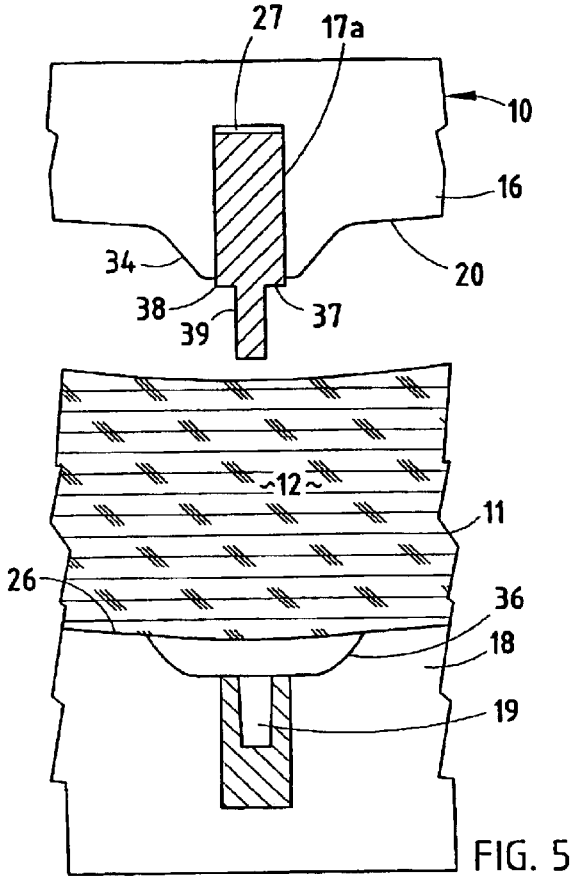
FIG. 5 is a side elevational cross-sectional view of the spaced upper and lower mold halves, having the hole forming punch adjusted, with a loosely felted mat of wood flakes positioned therebetween.
Figure 6:
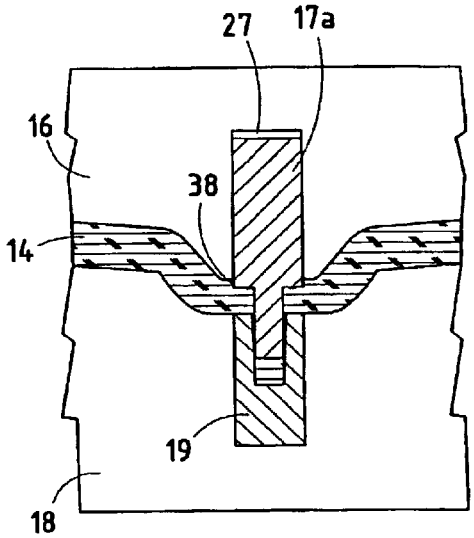
FIG. 6 is the same view of FIG. 5 with the mold closed, whereby the wood flakes are consolidated, compressed, and cured under heat and pressure to form a molded wood flake part having an adjusted hole in a boss.
Figure 7:
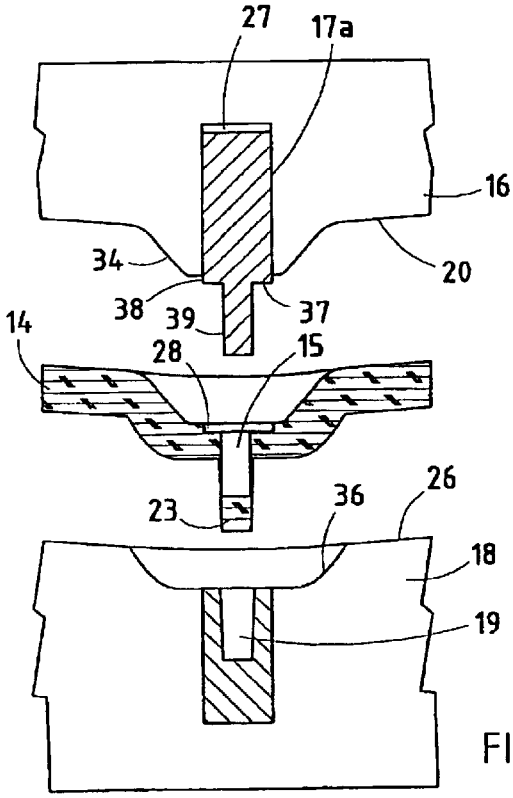
FIG. 7 is a side elevational view of the molded apparatus of FIG. 5 with the mold reopened and the part removed.
Figure 8:
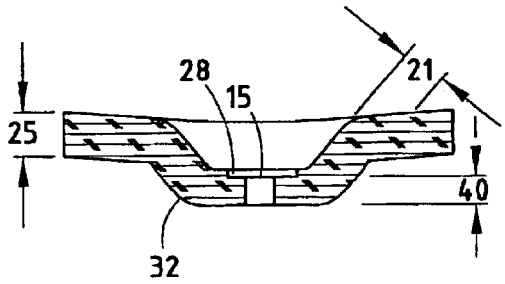
FIG. 8 is a side elevational cross-sectional view of the part once removed from the mold, showing the hole adjustment.

Alternatively, the male hole forming punch 17*a* of the top mold die 16 can be positioned in mold die 16 so that instead of shoulder 37 being flush with surface 20, it projects beyond the surface 20 of the top mold die 16 (FIG. 5). This can be accomplished, for example, by placing a spacer 27 in the bottom of the punch receiving well 36 of die 16 (FIG. 7). The extended projection 38 shortens the distance between the male hole forming punch 17 and the punch receiver 19 (FIG. 6). The projecting shoulder 37 further compresses the mat 11 at or near the hole 15 resulting in an increasingly narrow portion 28 in part 14 (FIG. 7). This results in increased densification of the part 14 in the area 40 around the hole when the adjustment is made to the hole forming punch 17*a*. When the male hole forming punch 17*a* is then adjusted, the density immediately around the hole 15 may be increased to approximately 50.3 pcf or any suitable level. An adjustment may also be made to the position of punch receiver 19 to assist in increasing the density near the hole 15.

The wood flakes 12 used in creating the molded wood flake part 14 can be prepared from various species of suitable hardwoods and softwoods used in the manufacture of particleboard. Representative examples of suitable woods include aspen, maple, oak, elm, balsam fir, pine, cedar, spruce, locust, beech, birch and mixtures thereof. Aspen is preferred.

Suitable wood flakes 12 can be prepared by various conventional techniques. Pulpwood grade logs, or so-called round wood, are converted into wood flakes 12 in one operation with a conventional roundwood flaker. Logging residue or the total tree is first cut into fingerlings in the order of 2–6 inches long with a conventional device, such as the helical comminuting shear disclosed in U.S. Pat. No. 4,053,004, and the fingerlings are flaked in a conventional ring-type flaker. Roundwood wood flakes 12 generally are higher quality and produce stronger parts because the lengths and thickness can be more accurately controlled. Also, roundwood wood flakes 12 tend to be somewhat flatter, which facilitates more efficient blending and the logs can be debarked prior to flaking which reduces the amount of less desirable fines produced during flaking and handling. Acceptable wood flakes 12 can be prepared by ring flaking fingerlings and this technique is more readily adaptable to accept wood in poorer form, thereby permitting more complete utilization of certain types of residue and surplus woods.

Irrespective of the particular technique employed for preparing the wood flakes 12, the size distribution of the wood flakes 12 is quite important, particularly the length and thickness. The wood flakes should have an average length of about 1¼ inch to about 6 inches and an average thickness of about 0.005 to about 0.075 inches. The average length of the wood flakes is preferably about 2 to about 3 inches. In any given batch, some of the wood flakes 12 can be shorter than 1¼ inch, and some can be longer than 6 inches, so long as the overall average length is within the above range. The same is true for the thickness.

The presence of major quantities of wood flakes 12 having a length shorter than about 1¼ inch tends to cause the felted mat 11 to pull apart during the molding step. The presence of some fines in the felted mat 11 produces a smoother surface and, thus, may be desirable for some applications so long as the majority of the wood flakes, preferably at least 75%, is longer than 1⅛ inch and the overall average length is at least 1¼ inch.

Substantial quantities of wood flakes 12 having a thickness of less than about 0.005 inches should be avoided, because excessive amounts of binder are required to obtain adequate bonding. On the other hand, wood flakes 12 having a thickness greater than about 0.075 inch are relatively stiff and tend to overlie each other at some incline when formed into the felted mat 11. Consequently, excessively high mold pressures are required to compress the wood flakes 12 into the desired intimate contact with each other. For wood flakes 12 having a thickness falling within the above range, thinner ones produce a smoother surface while thick ones require less binder. These two factors are balanced against each other for selecting the best average thickness for any particular application. The average thickness of the wood flakes 12 preferably is about 0.015 to about 0.25 inches, and more preferably about 0.0020 inch.

The width of the wood flakes 12 is less important. The wood flakes 12 should be wide enough to ensure that they lie substantially flat when felted during mat formation. The average width generally should be about 3 inches or less and no greater than the average length. For best results, the majority of the wood flakes 12 should have a width of about 1/16 inch to about 3 inches, and preferably 0.25 to 1.0 inches.

The blade setting on a flaker can primarily control the thickness of the wood flakes 12. The length and width of the wood flakes 12 are also controlled to a large degree by the flaking operation. For example, when the wood flakes 12 are being prepared by ring flaking fingerlings, the length of the fingerlings generally sets the maximum lengths. Other factors, such as the moisture content of the wood and the amount of bark on the wood affect the amount of fines produced during flaking. Dry wood is more brittle and tends to produce more fines. Bark has a tendency to more readily break down into fines during flaking and subsequent handling than wood.

While the flake size can be controlled to a large degree during the flaking operation as described above, it usually is necessary to use some sort of classification in order to remove undesired particles, both undersized and oversized, and thereby ensure the average length, thickness and width of the wood flakes 12 are within the desired ranges. When roundwood flaking is used, both screen and air classification usually are required to adequately remove both the undersize and oversize particles, whereas fingerling wood flakes 12 usually can be properly sized with only screen classification.

Wood flakes 12 from some green wood can contain up to 90% moisture. The moisture content of the mat must be substantially less for molding as discussed below. Also, wet wood flakes 12 tend to stick together and complicate classification and handling prior to blending. Accordingly, the wood flakes 12 are preferably dried prior to classification in a conventional type drier, such as a tunnel drier, to the moisture content desired for the blending step. The moisture content to which the wood flakes 12 are dried usually is in the order of about 6 weight % or less, preferably about 2 to about 5 weight %, based on the dry weight of the wood flakes 12. If desired, the wood flakes 12 can be dried to a moisture content in the order of 10 to 25 weight % prior to classification and then dried to the desired moisture content for blending after classification. This two-step drying may reduce the overall energy requirements for drying wood flakes 12 prepared from green woods in a manner producing substantial quantities of particles which must be removed during classification and, thus, need not be as thoroughly dried.

To coat the wood flakes 12 prior to being placed as a felted mat 11 within the cavity 30 within the mold 10, a known amount of the dried, classified wood flakes 12 is introduced into a conventional blender, such as a paddle-type batch blender, wherein predetermined amounts of a resinous particle binder, and optionally a wax and other additives, is applied to the wood flakes 12 as they are tumbled or agitated in the blender. Suitable binders include those used in the manufacture of particle board and similar pressed fibrous products and, thus, are referred to herein as "resinous particle board binders." Representative examples of suitable binders include thermosetting resins such as phenolformaldehyde, resorcinol-formaldehyde, melamine-formaldehyde, urea-formaldehyde, urea-furfuryl and condensed furfuryl alcohol resins, and organic polyisocyantes, either alone or combined with urea- or melamine-formaldehyde resins.

Particularly suitable polyisocyanates are those containing at least two active isocyanate groups per molecule, including diphenylmetbane diisocyanates, m- and p-phenylene diisocyanates, chlorophenylene diisocyanates, toluene di- and triisocyanates, triphenylmethene triisocyanates, diphenylether-2,4,4'-triisoccyanate and polyphenylpolyisocyanates, particularly diphenylmethane-4,4'-diisocyanate. So-called MDI is particularly preferred.

The amount of binder added to the wood flakes 12 during the blending step depends primarily upon the specific binder used, size, moisture content and type of the wood flakes 12, and the desired characteristics of the part being formed. Generally, the amount of binder added to the wood flakes 12 is about 2 to about 15 weight %, preferably about 4 to about 10 weight %, as solids based on the dry weight of the wood flakes 12. When a polyisocyanate is used alone or in combination with a urea-formaldehyde resin, the amounts can be more toward the lower ends of these ranges.

The binder can be admixed with the wood flakes 12 in either dry or liquid form. To maximize coverage of the wood flakes 12, the binder preferably is applied by spraying droplets of the binder in liquid form onto the wood flakes 12 as they are being tumbled or agitated in the blender. When polyisocyantes are used, a conventional mold release agent preferably is applied to the die or to the surface of the felted mat prior to pressing. To improve water resistance of the part, a conventional liquid wax emulsion preferably is also sprayed on the wood flakes 12 during the step. The amount of wax added generally is about 0.5 to about 2 weight %, as solids based on the dry weight of the wood flakes 12. Other additives, such as at least one of the following: a coloring agent, fire retardant, insecticide, fungicide, mixtures thereof and the like may also be added to the wood flakes 12 during the blending step. The binder, wax and other additives can be added separately in any sequence or in combined form.

The moistened mixture of binder, wax and wood flakes 12 or "furnish" from the blending step is formed into a loosely-felted, layered mat 11, which is placed within the cavity 30 prior to the molding and curing of the felted mat 11 into molded wood flake part 14. The moisture content of the wood flakes 12 should be controlled within certain limits so as to obtain adequate coating by the binder during the blending step and to enhance binder curing and deformation of the wood flakes 12 during molding.

The presence of moisture in the wood flakes 12 facilitates their bending to make intimate contact with each other and enhances uniform heat transfer throughout the mat during the molding step, thereby ensuring uniform curing. However, excessive amounts of water tend to degrade some binders, particularly urea-formaldehyde resins, and generate steam which can cause blisters. On the other hand, if the wood flakes 12 are too dry, they tend to absorb excessive amounts of the binder, leaving an insufficient amount on the surface to obtain good bonding and the surfaces tend to cause hardening which inhibits the desired chemical reaction between the binder and cellulose in the wood. This latter condition is particularly true for polyisocyanate binders.

Generally, the moisture content of the furnish after completion of blending, including the original moisture content of the wood flakes 12 and the moisture added during blending with the binder, wax and other additives, should be about 5 to about 25 weight %, preferably about 8 to about 12 weight %. Generally, higher moisture contents within these ranges can be used for polyisocyanate binders because they do not produce condensation products upon reacting with cellulose in the wood.

The furnish is formed into the generally flat, loosely-felted, mat 11, preferably as multiple layers. A conventional dispensing system, similar to those disclosed in U.S. Pat. Nos. 3,391,223 and 3,824,058, and 4,469,216 can be used to form the felted mat 11. Generally, such a dispensing system includes trays, each having one open side, carried on an endless belt or conveyor and one or more (e.g., three) hoppers spaced above and along the belt in the direction of travel for receiving the furnish.

When a multi-layered felted mat 11 is formed, a plurality of hoppers usually are used with each having a dispensing or forming head extending across the width of the carriage for successively depositing a separate layer of the furnish as the tray is moved beneath the forming heads. Following this, the tray is taken to the mold to place the felted mat within the cavity of bottom mold, by sliding the tray out from under mat.

In order to produce molded wood flake parts 14 having the desired edge density characteristics without excessive blistering and springback, the felted mat should preferably have a substantially uniform thickness and the wood flakes 12 should lie substantially flat in a horizontal plane parallel to the surface of the carriage and be randomly oriented relative to each other in that plane. The uniformity of the mat thickness can be controlled by depositing two or more layers of the furnish on the carriage and metering the flow of furnish from the forming heads.

Spacing the forming heads above the carriage so the wood flakes 12 must drop about 1 to about 3 feet from the heads en route to the carriage can enhance the desired random orientation of the wood flakes 12. As the flat wood flakes 12 fall from that height, they tend to spiral downwardly and land generally flat in a random pattern. Wider wood flakes 12 within the range discussed above enhance this action. A scalper or similar device spaced above the carriage can be used to ensure uniform thickness or depth of the mat, however, such means usually tend to align the top layer of wood flakes 12, i.e., eliminate the desired random orientation. Accordingly, the thickness of the mat that would optimally have the nominal part thickness preferably controlled by closely metering the flow of furnish from the forming heads. The mat thickness that would optimally have the nominal part thickness used will vary depending upon such factors as the size and shape of the wood flakes 12, the particular technique used for forming the mat 11, the desired thickness and density of the molded wood flake part 14 produced, the configuration of the molded wood flake part 14, and the molding pressure to be used.

Following the production of the felted mat 11 and placement of the felted mat 11 within the cavity 30 of the mold 10, the felted mat 11 mat is compressed and cured under heat and pressure when the top mold die 16 engages the bottom mold die 18.

The felted mat 11 is then compressed and cured between the top mold die 16 and the bottom mold 18 to become the molded wood flake part 14 with a hole 15. After the molded wood flake part 14 is produced by the method of the present invention, any flashing or caps 23 are removed by conventional means.

The surface 20 of the top mold die 16 and the surface 26 of the bottom mold die 18 fit closer together near the boss 32 and hole 15, formed by the male hole forming punch 17 and punch receiver 19, thus compressing the felted mat 11 more at the peripheries of the hole 15 in boss 32. The resulting wood flake part 14 has a thinner portion 21 in the boss 32 near the hole 15, which serves to strengthen the peripheries of the hole 15. The thinner portion 21 may have near to or more than the target density of the entire part 14.

The illustrated example shows the hole 15 being formed in a raised boss 32 (FIG. 3). The raised boss 32 is created by a boss forming projection 34 in the top surface 20 and the corresponding boss forming recess or wall 36 in bottom surface 26. It is envisioned that the hole 15 and/or boss 32 can be created by having the male hole forming punch 17 in either top mold die 16 or bottom mold die 18. Furthermore, in accordance with the present invention, the hole 15 may be made in the part 14, without a raised boss 32.

The above description is that of the preferred embodiment only. Modifications of the invention will occur to those skilled in the art and to those who make or use the invention. Therefore, it is understood that the embodiment described above is merely for illustrative purposes and not intended to limit the scope of the invention, which is defined by the following claims as interpreted according to the principles of patent law, including the Doctrine of Equivalents.

What is claimed is:

1. A method of molding a three dimensional article from binder coated wood flakes with a hole formed therein, comprising:

forming a loosely felted mat of said wood flakes;

depositing said mat onto a lower mold die;

providing a hole forming projection in one of said mold dies for forming a hole in a part made in said mold dies;

narrowing said part defining mold cavity surrounding said hole forming projection; and compressing and heating said mat between an upper mold die and said lower mold die, said upper and lower mold dies forming a part defining mold cavity therebetween.

2. The method of claim 1, wherein said mold dies are adapted to form a boss in said three dimensional article, around said hole.

3. The method of claim 2, wherein said hole forming projection includes a shoulder which projects beyond the surface of said mold die to cause said narrowing of said part defining mold cavity.

4. The method of claim 1, wherein said hole forming projection includes a shoulder which projects beyond the surface of said mold die to cause said narrowing of said part defining mold cavity.

5. The method of claim 4, wherein said wood flakes have an average length of from about 1¼ to about 6 inches, an average thickness of from about 0.015 to about 0.25 inches, and an average width of less than the average length, and no greater than about 3 inches.

6. The method of claim 1, wherein said wood flakes have an average length of from about 1¼ to about 6 inches, an average thickness of from about 0.015 to about 0.25 inches, and an average width of less than the average length, and no greater than about 3 inches.

7. The method of claim 1, wherein said wood flakes of said mat have an average length of from about 2 to about 3 inches.

8. The method of claim 7, wherein said wood flakes of said mat have an average thickness of from about 0.015 to about 0.025 inches.

9. The method of claim 8, wherein said wood flakes of said mat have an average width of from about 0.25 to about 1.0 inches.

10. A method of molding a three dimensional article with a hole formed therein, from binder coated wood flakes comprising:

forming a loosely felted mat of said wood flakes;

depositing said mat onto a lower mold die;

providing a hole forming projection in one of said mold dies for forming a hole in a part made in said mold dies;

narrowing said part defining mold cavity surrounding said hole forming projection;

wherein said mold dies being adapted to form a boss in said three dimensional article, around said hole;

wherein said wood flakes have an average length of from about 1¼ to about 6 inches, an average thickness of from about 0.015 to about 0.25 inches, and an average width of less than the average length, and no greater than about 3 inches; and compressing and heating said mat between an upper mold die and said lower mold die, said upper and lower mold dies forming a part defining mold cavity therebetween.

11. A three dimensional article of manufacture with a hole formed from binder coated wood flakes, wherein said wood flakes are formed into a loosely felted mat which is further deposited onto a lower mold die;

wherein said mat is compressed and heated between an upper mold die and said lower mold die, at least one of which includes a hole forming projection projecting from the surface thereof;

wherein said upper and lower mold dies form a part defining cavity therebetween; and wherein said part defining cavity is narrower near said hole forming projection, in order to compress said loosely felted mat more near said hole forming punch than is generally the case in the rest of said cavity.

12. The three dimensional article of manufacture of claim 11, wherein said mold dies are adapted to form a boss in said three dimensional article, around said hole.

13. The three dimensional article of manufacture of claim 12, wherein said hole forming projection includes a shoulder which projects beyond the surface of said mold die to cause said narrowing of said part defining mold cavity.

14. The three dimensional article of manufacture of claim 11, wherein said hole forming projection includes a shoulder which projects beyond the surface of said mold die to cause said narrowing of said part defining mold cavity.

15. The three dimensional article of manufacture of claim 14, wherein said wood flakes have an average length of from about 1¼ to about 6 inches, an average thickness of from about 0.015 to about 0.25 inches, and an average width of less than the average length, and no greater than about 3 inches.

16. The three dimensional article of manufacture of claim 11, wherein said wood flakes have an average length of from about 1¼ to about 6 inches, an average thickness of from about 0.015 to about 0.25 inches, and an average width of less than the average length, and no greater than about 3 inches.

17. The three dimensional article of manufacture of claim 11, wherein said wood flakes of said mat have an average length of from about 2 to about 3 inches.

18. The three dimensional article of manufacture of claim 17, wherein said wood flakes of said mat have an average thickness of from about 0.015 to about 0.025 inches.

19. The three dimensional article of manufacture of claim 18, wherein said wood flakes of said mat have an average width of from about 0.25 to about 1.0 inches.

* * * * *

UNITED STATES PATENT AND TRADEMARK OFFICE

CERTIFICATE OF CORRECTION

PATENT NO. : 6,830,797 B2
DATED : December 14, 2004
INVENTOR(S) : Bruce A. Haataja It is certified that error appears in the above-identified patent and that said Letters Patent is hereby corrected as shown below:

Column 6,
Line 51, before "step" insert -- blending --.

Signed and Sealed this

Twenty-sixth Day of April, 2005

JON W. DUDAS
*Director of the United States Patent and Trademark Office*